US011549740B2

(12) United States Patent
Kim et al.

(10) Patent No.: US 11,549,740 B2
(45) **Date of Patent: *Jan. 10, 2023**

(54) REFRIGERATOR AND CONTROLLING METHOD FOR THE SAME

(71) Applicant: LG ELECTRONICS INC., Seoul (KR)

(72) Inventors: Sungwook Kim, Seoul (KR); Kyongbae Park, Seoul (KR); Sangbok Choi, Seoul (KR); Yunsu Cho, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 120 days.

This patent is subject to a terminal disclaimer.

(21) Appl. No.: 16/965,273

(22) PCT Filed: Dec. 21, 2018

(86) PCT No.: PCT/KR2018/016458

§ 371 (c)(1),
(2) Date: Jul. 27, 2020

(87) PCT Pub. No.: WO2019/164115

PCT Pub. Date: Aug. 29, 2019

(65) Prior Publication Data

US 2021/0071931 A1 Mar. 11, 2021

(30) Foreign Application Priority Data

Feb. 26, 2018 (KR) ..... 10-2018-0022682

(51) Int. Cl.
*F25D 21/00* (2006.01)
*F25D 21/02* (2006.01)

(52) U.S. Cl.
CPC ..... *F25D 21/006* (2013.01); *F25D 21/025* (2013.01)

(58) Field of Classification Search
CPC ..... F25D 21/02; F25D 2700/10; F25D 29/00; F25D 21/08; F25D 21/025; F25D 21/002; F25D 17/067; F25D 17/062; F25D 21/008
See application file for complete search history.

(56) References Cited

U.S. PATENT DOCUMENTS 2,975,611 A 8/1959 Pietsch
3,299,237 A 1/1967 Sorensen et al.
(Continued)

FOREIGN PATENT DOCUMENTS

CN 105783387 A 7/2016
KR 1019930004721 A 3/1993
(Continued)

OTHER PUBLICATIONS

MIT OpenCourseWare Dynamics and Control II (Year: 2008).*
Machine Translation of KR 10-0652775 (Year: 2006).*

*Primary Examiner* — Lionel Nouketcha
(74) *Attorney, Agent, or Firm* — Dentons US LLP

(57) ABSTRACT

There is disclosed a controlling method for a refrigerator comprising: a first defrosting step of performing defrosting for an evaporator, the first defrosting step which ends when the temperature of the evaporator reaches a first temperature; a pressure difference sensing step of measuring a difference between the pressure in a first through-hole arranged between an inlet hole for drawing air from a storage compartment and the evaporator and the pressure in a second through-hole arranged between an outlet hole for discharging air towards the storage compartment and the evaporator by using one differential pressure sensor; and a second defrosting step of performing additional defrosting for the evaporator when the measured pressure difference is a preset pressure or more.

20 Claims, 6 Drawing Sheets

(56) References Cited

U.S. PATENT DOCUMENTS

| | | | | |
|---|---|---|---|---|
| 3,309,887 | A | 3/1967 | Jacobus | |
| 3,377,817 | A * | 4/1968 | Petranek | F25D 21/025 62/151 |
| 4,007,603 | A | 2/1977 | Gustafsson | |
| 2013/0160471 | A1* | 6/2013 | Worley | F25D 21/08 62/81 |

FOREIGN PATENT DOCUMENTS

| | | | |
|---|---|---|---|
| KR | 10-1998-0010300 | A | 4/1994 |
| KR | 10-0120536 | B1 | 10/1997 |
| KR | 0120536 | B1 * | 10/1997 |
| KR | 1019980009887 | A | 4/1998 |
| KR | 10-0652775 | B1 | 8/2001 |
| KR | 10-0304907 | B1 | 9/2001 |
| KR | 10-1463041 | B1 | 11/2014 |
| WO | 2017-131426 | A1 | 8/2017 |
| WO | 2018-088839 | A1 | 5/2018 |
| WO | 2018/088845 | A1 | 5/2018 |

* cited by examiner

[Fig. 1]
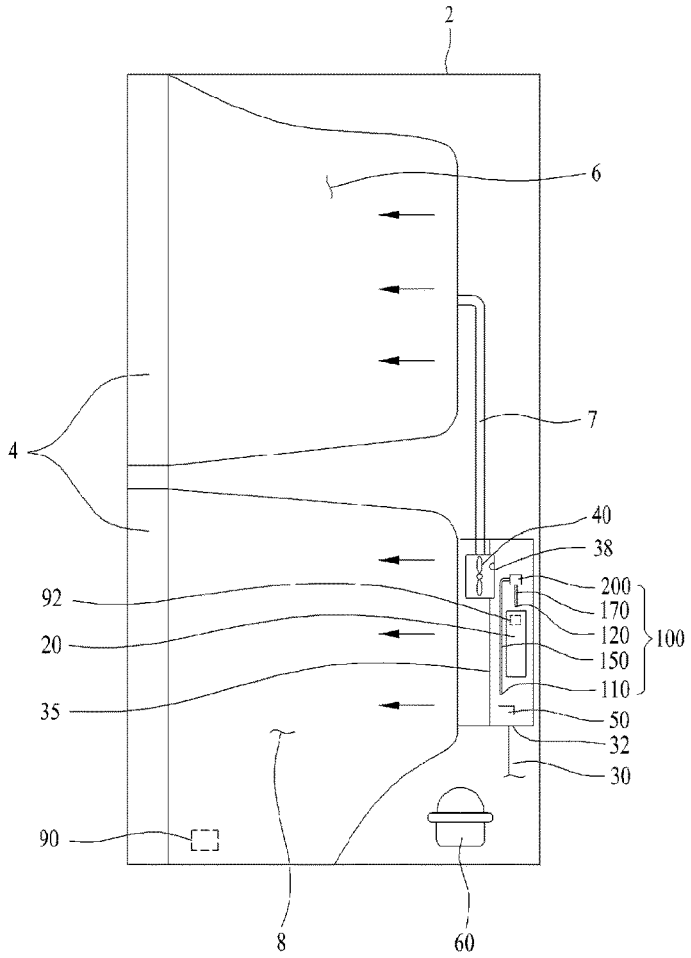
[Fig. 2]
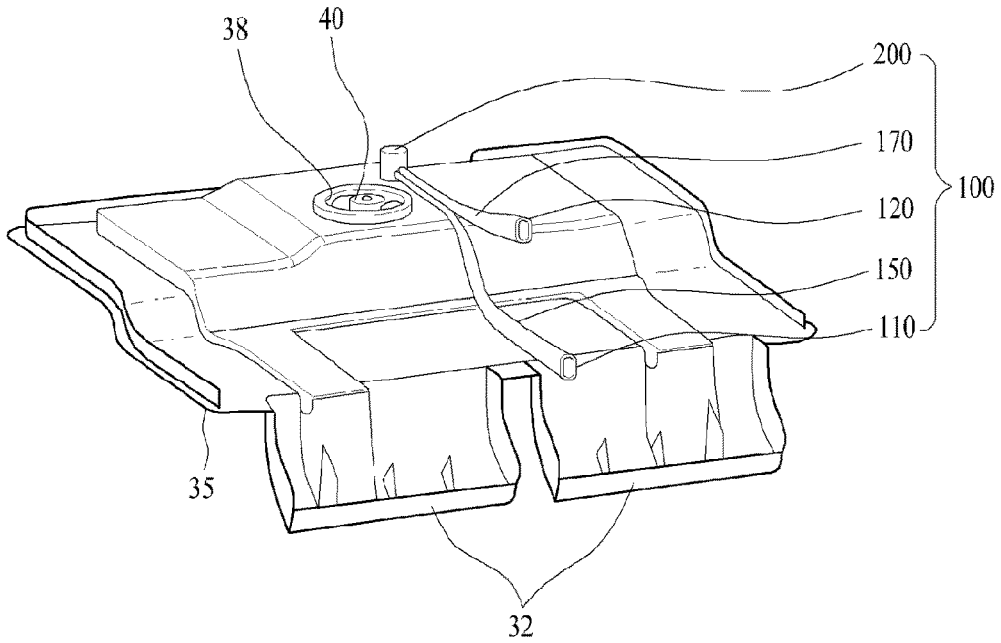

[Fig. 3]
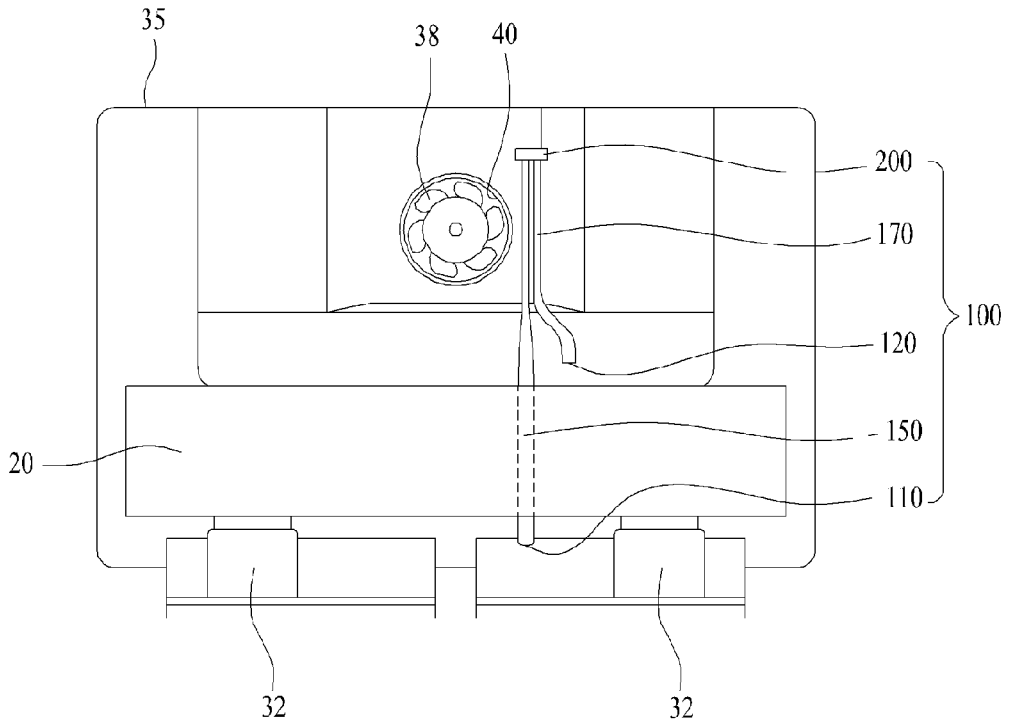
[Fig. 4]
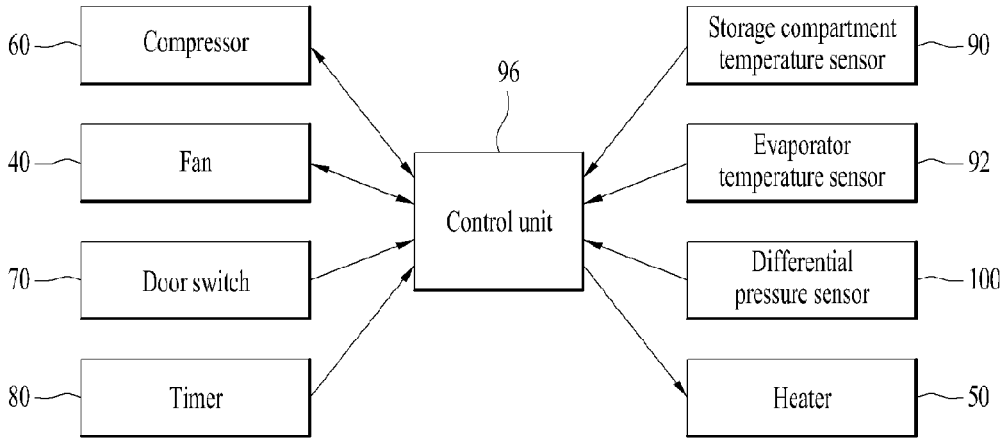

[Fig. 5]
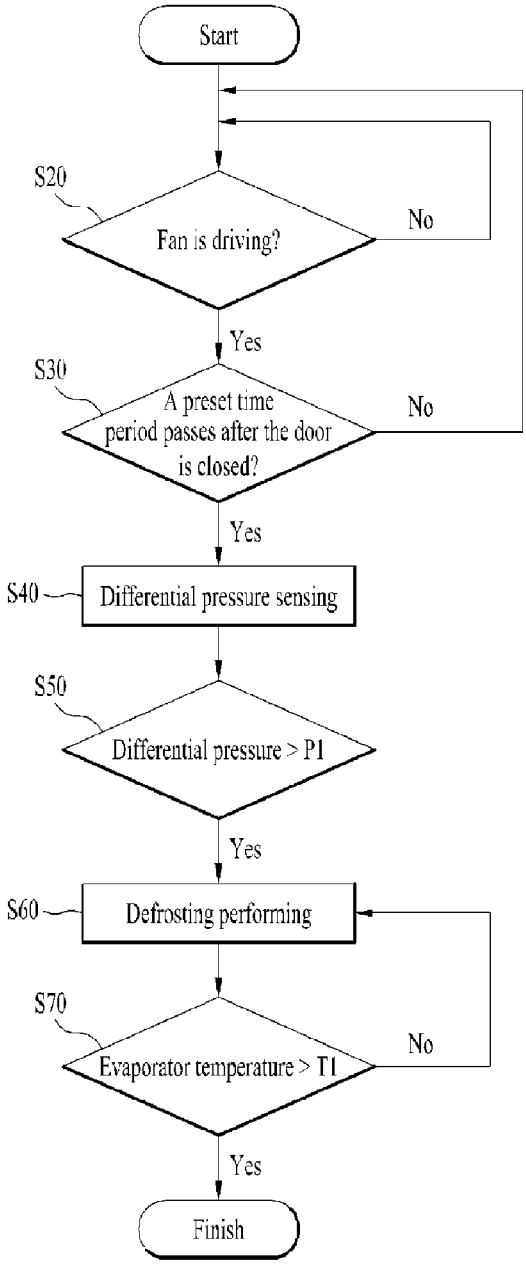

[Fig. 6]
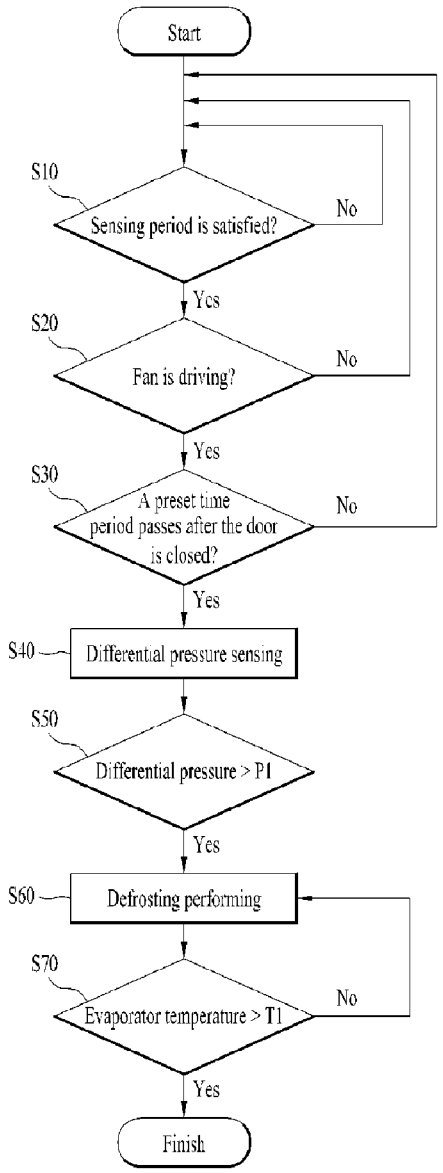
[Fig. 7]
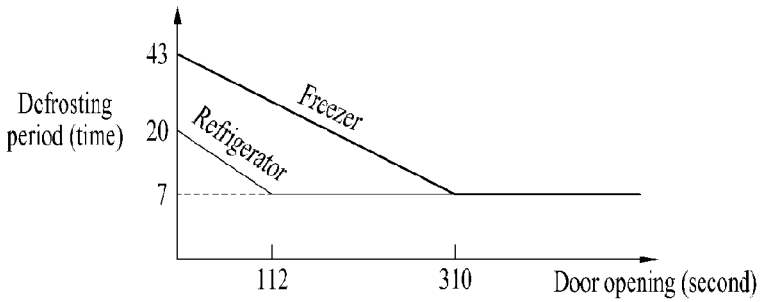

[Fig. 8]
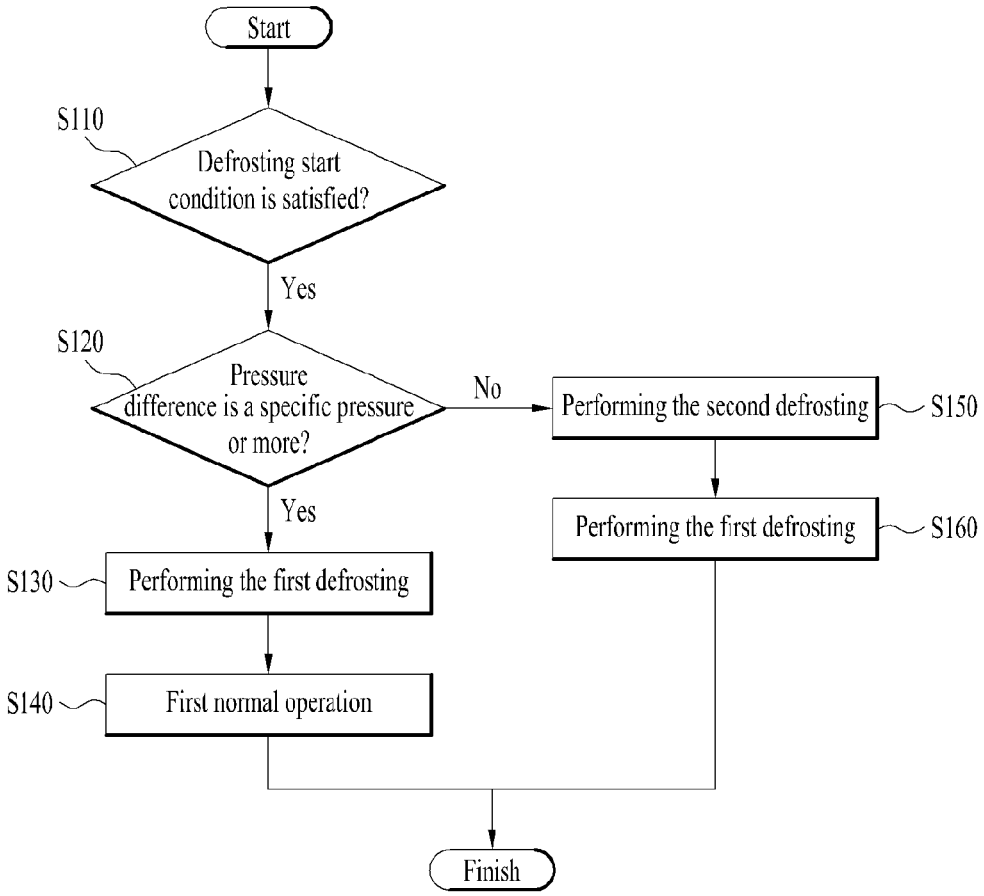

[Fig. 9]
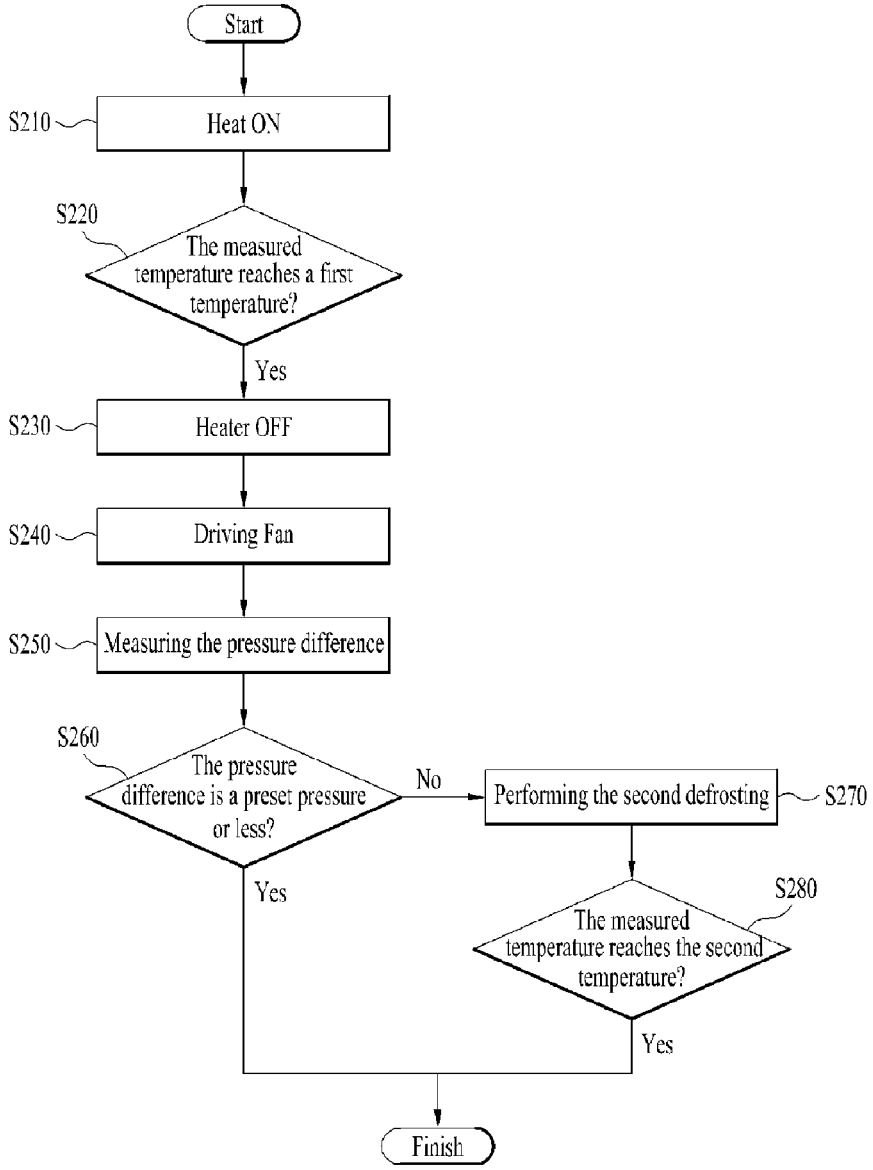

REFRIGERATOR AND CONTROLLING METHOD FOR THE SAME

This application is a National Stage Application of International Application No. PCT/KR2018/016458, filed on Dec. 21, 2018, which claims priority to Korean Patent Application No. 10-2018-0022682, filed on Feb. 26, 2018, which are hereby incorporated by reference in their entirety for all purposes as if fully set forth herein.

FIELD

Embodiments of the present disclosure relate to a refrigerator and a control method for the same, more particularly, a refrigerator having enhanced energy efficiency and a control method for the same.

BACKGROUND

Generally, a refrigerator has a mechanical chamber provided in a lower area of a cabinet. The mechanical chamber is typically installed in the lower area of the refrigerator, considering the weight center of the refrigerator, the assembling utility and vibration reduction.

A freeze cycling mechanism is installed in the mechanical chamber of the refrigerator. The freeze cycling mechanism is configured to preserve foods fresh by keeping an inner space of the refrigerator on being in a freezer or refrigerator state, using a property of a refrigerant that absorbing external heat while a low-pressure liquid refrigerant is converted into a gas refrigerant.

The freeze cycling mechanism of the refrigerator includes a compressor configured to convert a low-temperature-and-low-pressure gas refrigerant into a high-temperature-and-high-pressure gas refrigerant; a condenser configured to convert the high-temperature-and-high-pressure gas refrigerant converted by the compressor into a low-temperature-and-high-pressure liquid refrigerant; and an evaporator configured to convert the low-temperature-and-high-pressure liquid refrigerant into a gas refrigerant to absorb external heat.

When the compressor is driving, the temperature of the evaporator falls and ice is stuck to the evaporator. Once more ice is stuck to the evaporator, heat-exchange efficiency between the evaporator and air deteriorates enough to make it difficult to chill and generate a sufficient cold air which is supplied to storage compartments. Accordingly, the compressor has to be driving more frequently for a longer time period, which is disadvantageous.

Moreover, once ice forms on the evaporator, a heater starts to drive to remove the ice from the evaporator. If the heater is driven unnecessarily often, the refrigerator is likely to consume more energy disadvantageously.

Especially, a refrigerator that is produced recently tends to have a large storage capacity and then have high power consumption. Accordingly, many studies and researches are ongoing to reduce such high power consumption.

DETAILED DESCRIPTION OF THE INVENTION

Technical Problem

To overcome the disadvantages, an object of the present invention is to address the above-noted and other problems and to provide a refrigerator having enhanced energy efficiency and a controlling method for the same.

Another object of the present invention is to provide a refrigerator which may perform a secondary defrosting process after a first defrosting process, unless the first defrosting process is performed sufficiently, and a controlling method for the same.

Technical Solution

To achieve these objects and other advantages and in accordance with the purpose of the embodiments, as embodied and broadly described herein, a controlling method for a refrigerator comprises a step of determining whether a defrosting start condition for an evaporator is satisfied; a step of sensing a difference between the pressure of air in a first through-hole arranged in an inlet hole for drawing air from a storage compartment and the evaporator and the pressure of air in a second through-hole arranged between an outlet hole for discharging air into the storage compartment and the evaporator by using one differential pressure sensor; and a step of performing defrosting differently according to the measured pressure difference.

In the defrosting step, a heater is driven to heat the evaporator.

In the defrosting step, when the measured pressure difference is larger than a specific pressure, the temperature of the evaporator rises to a first preset temperature. When the measured pressure difference is smaller than a specific pressure, the temperature of the evaporator rises to a second preset temperature.

The first preset temperature may be higher than the first preset temperature.

An evaporator temperature sensor installed in the evaporator may measure the temperature.

In the defrosting step, when the measured pressure difference is larger than the specific pressure, the heater may supply a relatively small amount of heat, compared with when the measured pressure difference is smaller than the specific pressure.

When the measured pressure difference is larger than the specific pressure, the heater may be continuously driven until the defrosting step ends.

When the measured pressure difference is smaller than the specific pressure, on/off of the heater may be repeated during the defrosting step.

The heater may be continuously driven until the temperature of the evaporator reaches a specific temperature.

After the temperature of the evaporator rises the specific temperature, the heater may be intermittently driven.

Once the defrosting step is completed, a normal operation step of cooling the storage compartment may be further provided.

The normal operation step may primarily cool the storage compartment to a preset temperature after the defrosting step.

In the normal operation step, when the measured pressure difference is larger than a specific pressure, the compressor may be driven to generate a relatively high cooling power. When the measured pressure difference is smaller than the specific pressure, the compressor may be driven to generate a relatively low cooling power.

When the compressor generates the relatively high cooling power, the driving rpm of the compressor is relatively higher than the driving rpm when it generates the relatively low cooling power.

Embodiments of the present invention also provide a refrigerator comprising a cabinet in which a storage compartment is provided; a door configured to open and close the storage compartment; a case in which an evaporator is provided, the case comprising an inlet hole formed to draw air from the storage compartment and an outlet hole formed to discharge air into the storage compartment; a fan provided to generate flow of air that is drawn via the inlet hole and discharged via the outlet hole; a differential pressure sensor provided in the case; and a control unit configured to differently perform defrosting for the evaporator according to the pressure difference measured by the differential pressure sensor.

The refrigerator may further comprise a heater provided to heat the evaporator.

When the pressure difference measured by the differential pressure sensor is larger than a specific pressure, the control unit may drive the heater to raise the temperature of the evaporator to a higher temperature.

When the pressure difference sensed by the differential pressure sensor is larger than the specific pressure, the control unit may continuously drive the heater until the defrosting for the evaporator ends.

When the pressure difference sensed by the differential pressure sensor is larger than the specific pressure, the control unit may control the compressor to supply a larger cooling power after the defrosting for the evaporator.

The differential pressure sensor may comprise a first through-hole arranged between the evaporator and the inlet hole; a second through-hole arranged between the evaporator and the outlet hole; and a body provided to connect the first through-hole and the second through-hole with each other, and the differential pressure sensor senses a difference between the pressure of the air penetrating the first through-hole and the pressure of the air penetrating the second through-hole.

Embodiments of the present invention also provide a controlling method for a refrigerator comprising: a first defrosting step of performing defrosting for an evaporator, the first defrosting step which ends when the temperature of the evaporator reaches a first temperature; a pressure difference sensing step of measuring a difference between the pressure in a first through-hole arranged between an inlet hole for drawing air from a storage compartment and the evaporator and the pressure in a second through-hole arranged between an outlet hole for discharging air towards the storage compartment and the evaporator by using one differential pressure sensor; and a second defrosting step of performing additional defrosting for the evaporator when the measured pressure difference is a preset pressure or more.

The controlling method may further comprise an operation step of driving a compressor configured to cool the storage compartments when the measured pressure difference is the presser pressure or less.

The operation step may be performed after the second defrosting step is completed, when the measured pressure difference is larger than the preset pressure.

In the operation step, the fan may be driven to supply the air heat-exchanged with the evaporator to the storage compartment.

A heater may be driven to heat the evaporator in the first defrosting step and the second defrosting step.

The first temperature may be lower than the second temperature.

The first temperature may be equal to the second temperature.

The controlling method may further comprise a step of driving the fan to supply the air heat-exchanged in the evaporator to the storage compartment, the fan driving step arranged between the first defrosting step and the pressure difference sensing step.

The pressure difference may be measured after the fan driving step is performed for a specific time period.

The fan driving step may be performed in a preset time period after the first defrosting step is completed.

In the first defrosting step and the second defrosting step, the fan configured to supply the air heat-exchanged in the evaporator to the storage compartment may not be driven. Embodiments of the present invention also provide a refrigerator comprising: a cabinet in which a storage compartment is provided; a door configured to open and close the storage compartment; a case in which an evaporator is provided, the case comprising an inlet hole formed to draw air from the storage compartment and an outlet hole formed to discharge air into the storage compartment; a fan provided to generate flow of air that is drawn via the inlet hole and discharged via the outlet hole; a differential pressure sensor provided in the case; and a control unit configured to determine whether to perform additional defrosting for the evaporator according to the pressure difference sensed by the differential pressure sensor.

The control unit may measures the pressure difference after the defrosting for heating the evaporator is performed.

Advantageous Effects

Accordingly, the embodiments have following advantageous effects. According to at least one embodiment of the present disclosure, the refrigerator may enhance energy efficiency by performing the defrosting process differently based on a degree of ice-formation on the evaporator. If too much ice is formed on the evaporator, more energy is consumed in the defrosting. If unless much ice is formed on the evaporator, less energy is consumed in the defrosting and the energy efficiency may be enhanced. Furthermore, when the storage compartment is cooled by driving the compressor according to the defrosting degree, the cooling power of the compressor may be adjusted and the energy consumed in cooling the storage compartment may be saved. If the defrosting is performed strongly, the storage compartment may be cooled rapidly. If the defrosting is performed weakly, the storage compartment may be cooled slowly and the temperature of the foods stored in the storage compartment may be prevented from rising.

Still further, according to the refrigerator, it is determined whether the additional defrosting is required after the first defrosting is performed weakly. Accordingly, the unnecessarily too much defrosting for the evaporator may be prevented. In other words, only when the additional defrosting for the evaporator is required after the first defrosting, the second defrosting is performed and the energy consumed in performing the defrosting may be saved.

Still further, the ice formation degree on the evaporator is figured out after the first defrosting and the reliability on the defrosting for the evaporator may be enhanced. Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings, which are given by illustration only, and thus are not limitative of the present invention, and wherein:

FIG. 1 is a cut-away view of a lateral surface provided in a refrigerator according to one embodiment of the present invention;

FIG. 2 is a diagram illustrating key parts of FIG. 1;

FIG. 3 is a plane view of FIG. 2;

FIG. 4 is a control block diagram of the refrigerator;

FIG. 5 is a flow chart illustrating a control method of sensing ice-formation on an evaporator according to one embodiment;

FIG. 6 is a flow chart illustrating a control method of sensing ice-formation on an evaporator according to one modified embodiment;

FIG. 7 is a diagram illustrating a point of time for performing a defrosting process according to another embodiment;

FIG. 8 is a flow chart illustrating a control method of sensing a degree of ice-formation on an evaporator after a defrosting process starts according to the embodiment; and FIG. 9 is a flow chart to determine whether additional defrosting is needed after the first defrosting according to the embodiment.

DESCRIPTION OF SPECIFIC EMBODIMENTS

Referring to the accompanying drawings, exemplary embodiments of the present disclosure will be described in detail.

Regardless of numeral references, the same or equivalent components may be provided with the same reference numbers and description thereof will not be repeated. For the sake of brief description with reference to the drawings, the sizes and profiles of the elements illustrated in the accompanying drawings may be exaggerated or reduced and it should be understood that the embodiments presented herein are not limited by the accompanying drawings.

In embodiments of the present invention, there is a difference between a technical feature that two pressure sensors are used and another technical feature that one differential pressure sensor is used. If two pressure sensors are used, a difference between the pressures measured by the two pressure sensors is used in calculating a pressure difference between two positions.

Typically, a conventional pressure sensor measures pressure values by the 100 PA. In the embodiments of the present invention, a differential pressure sensor is used and able to to measure a sophisticated pressure difference, compared with a conventional pressure sensor. The differential pressure sensor is unable to measure an absolute pressure value at a measured position but able to calculate a pressure difference between two positions, such that it may be advantageous in measuring a small unit difference, compared with the pressure sensor.

If two pressure sensors are used, two sensors are applied and more cost or other resources (e.g., a wire for installing two sensors). On the other hand, if one differential pressure sensor is used, the cost and sources for installing the sensor may be saved.

The position at which the differential pressure sensor will be installed may be in the space which will be chilled with the air having passed the storage compartment by the evaporator. The air supplied from the storage compartment absorbs and contains much moisture from the foods stored in the storage compartment such that it may be chilled while exchanging heat with the evaporator only to generate many ices or water drops. In other words, the space having the differential pressure sensor may be highly humid. Moreover, when the refrigerant is vaporized in the evaporator, ambient temperature near the evaporator is quite low. On the other hand, unless the refrigerant is vaporized in the evaporator, the ambient temperature near the evaporator is similar to the temperature of the storage compartment. Accordingly, the space where the evaporator is installed has a severe temperature difference according to a using condition of the evaporator.

As the space having the evaporator has a large temperature difference and a high humidity, various errors are likely to occur and it is difficult for the sensor to measure the accurate information. In the embodiment of the present invention, the differential pressure sensor is used and the accurate information can be sensed advantageously even under unfavorable conditions.

Hereinafter, an exemplary embodiment of the present invention to realize the object specifically will be described, referring to the accompanying drawings.

FIG. 1 is a cut-away view of a lateral surface provided in a refrigerator according to one embodiment of the present invention. FIG. 2 is a diagram illustrating key parts of FIG. 1. FIG. 3 is a plane view of FIG. 2. In FIG. 2, an evaporator is omitted to simplify the drawing.

Referring to FIGS. 1 through 3, the embodiment will be described.

The refrigerant includes a cabinet 1 having a plurality of storage compartments 6 and 8; and a door 4 provided to open and close the storage compartment 6 and 8.

The storage compartments 6 and 8 may include a first storage compartment 6 and a second storage compartment 8. The first and second storage compartments 6 and 8 may realize a refrigerator compartment and a freezer compartment, respectively, or vice versa. Alternatively, the first and second storage compartments 6 and 8 may realize one refrigerator or freezer compartment.

A storage compartment temperature sensor 90 may be provided in the storage compartments 6 and 8 to measure the temperatures inside the storage compartments 6 and 8. Specifically, the temperature sensors 90 may be provided in the storage compartments 6 and 8, respectively, and measure the temperatures in the storage compartments 6 and 8 independently.

A case 35 may be provided behind the storage compartments and the case 35 may accommodate the evaporator 20.

An outlet hole 38 may be provided in the case 35 to supply air to the storage compartment from the case 35 and an inlet hole 32 is formed in the case to supply air to the inside of the case 35 from the storage compartment.

An inlet pipe 30 is provided in the inlet hole 32 to guide the air into the case 35 such that an air channel may be formed by connecting the storage compartments 6 and 8 to the case 35.

A fan 40 is provided in the outlet hole 38 to cause an air flux towards the storage compartments 7 and 8 from the case 35. The case 35 may be structured to be sealed except the inlet hole 32 and the outlet hole 38. Once the fan 40 is driving, the air flow is formed from the inlet hole 32 to the outlet hole 38.

The air having passed the fan 40 is guided towards the first storage compartment 6 by a duct 7 such that cold air may be supplied to the first storage compartment 6. The air having passed the fan 40 may be supplied to the second storage compartment 8.

The evaporator 20 may be mounted in the case 35 and configured to generate cold air by vaporizing the refrigerant compressed by a compressor 60. The air inside the case 35 is chilled while exchanging heat with the evaporator 20.

A heater 50 is provided under the evaporator 20 and configured to generate heat so as to defrost the evaporator 20. The heater 50 is not necessarily provided under the evaporator 20 but mounted in the case 35 if it is able to heat the evaporator 20.

An evaporator temperature sensor 92 is provided in the evaporator 20 to measure the temperature of the evaporator 20. The evaporator temperature sensor 92 is able to sense a preset low temperature when the refrigerant penetrating the evaporator 20 is vaporized and a preset high temperature when the heater 50 is driving.

The compressor 60 is provided in a mechanical chamber provided in the cabinet 2 and configured to compress the refrigerant supplied to the evaporator 20. The compressor 60 is installed outside the case 35.

The inlet hole 32 is located under the evaporator 20 and the outlet hole 38 is located above the evaporator 20. The outlet hole 38 is arranged higher than the evaporator 20 and the inlet hole 32 is arranged lower than the evaporator 20.

Accordingly, once the fan 40 is driving, air rises in the case 35. The air drawn via the inlet hole 32 is heat-exchanged while passing the evaporator 20 and discharged outside the case 35 via the outlet hole 38.

A differential pressure sensor 100 is provided in the case 35.

The differential pressure sensor 100 includes a first through-hole 110 arranged between the evaporator 20 and the inlet hole 32; and a second through-hole 120 arranged between the evaporator 20 and the outlet hole 32.

The differential pressure sensor 100 also includes a body provided to connect the first through-hole 110 and the second through-hole 120 with each other. The body includes a first pipe 150 having the first through-hole 110 formed therein; a second pipe 170 having the second through-hole 120 formed therein; and a connection member 200 provided to connect the first pipe 150 and the second pipe 170 with each other.

In this instance, the connection member 200 is arranged higher than the evaporator 20 to prevent the moisture or water condensed by the evaporator 20 from falling to the connection member 200. An electronic device may be installed in the connection member 200. If water drops fall, the electronic device is likely to damage. The water drops formed on the evaporator 20 will be dropped down by the gravity. If the connection member 200 is arranged higher than the evaporator 20, the water drops will not fall down to the connection member 200 from the evaporator 20.

Meanwhile, the first pipe 150 and the second pipe 170 may be extended higher than the evaporator 20. To locate the connection member 200 higher than the evaporator 20, the first pipe 150 and the second pipe 170 have to be longitudinally extended over the evaporator 20.

The first through-hole 110 and the second through-hole 120 are arranged downwardly so as to prevent the water drops condensed in the case 35 from flowing into the first pipe 150 and the second pipe 170 there through. If the first and second through-holes 110 and 120 are arranged upwardly, the water drops dropped by the gravity might be drawn into the first pipe 150 and the second pipe 170 through the first through-hole 110 and the second through-hole 120 and then cause an error of the value measured by the differential pressure sensor 100.

The differential pressure sensor 100 may sense a difference between the pressures of the air penetrating the first and second through-holes 110 and 120. The installation heights of the first and second through-holes 110 and 120 are different from each other and the first and second through-holes have the evaporator 20 arranged there between, only to generate a pressure difference. The second through-hole 120 is a low pressure area such that a relatively low pressure is applied. The first through-hole 110 is a high pressure area such that a relatively high pressure is applied. Accordingly, the differential pressure sensor 100 senses the pressure difference.

Especially, when the fan 40 is driving, air flow occurs in the case 35 and the differential pressure sensor 100 is able to measure a pressure difference.

FIG. 4 is a control block diagram according to the present invention.

Referring to FIG. 4, the refrigerator according to the present invention includes a compressor 60 configured to compress a refrigerant. The control unit 96 is implemented to drive the compressor 60 when it is necessary to chill the storage compartments and supply a cold air to the storage compartment. The control unit 96 may be provided with information about the driving of the compressor 60.

A fan 40 may be further provided to generate air flow so as to supply cold air to the storage compartments. The control unit 96 may be also provided with information about the driving of the fan 40. The control unit 96 may transmit a signal configured to drive the fan 40.

A door switch 70 may be provided to acquire information about the opening and closing of the door to open and close the storage compartments. A door switch 70 may be provided in the doors, respectively, to sense whether the doors open or close the storage compartment, respectively.

Moreover, a timer 80 is provided to sense the elapsed time. The time measured by the timer 80 is transmitted to the control unit 96. For example, the control unit 96 acquires a signal indicating that the door 4 closed the storage compartment from the door switch 70 and it is then provided with information about the elapsed time after the door 4 closed the storage compartment by the timer 80.

The information on the temperature of the storage compartment measured by the storage compartment temperature sensor 90 may be transmitted to the control unit 96. When the defrosting is performed, the information about the temperature of the storage compartment measured by the storage compartment temperature sensor 90 may be also transmitted to the control unit 96. The control unit 96 may end the defrosting for the evaporator according to the information about the temperature measured by the evaporator temperature sensor 92.

Also, the heater 50 configured to heat the evaporator is provided and the control unit 96 is able to transmit a signal for driving the heater 50. Once the defrosting starts, the control unit 96 is implemented to drive the heater 50. Once the defrosting is completed, the control unit 96 is implemented to end the driving of the heater 50.

In the present invention, the information measured by the differential pressure sensor 100 is transmitted to the control unit 96.

FIG. 5 is a flow chart illustrating a control method of sensing ice-formation on an evaporator according to one embodiment.

Referring to FIG. 5, the controlling method according to this embodiment of the present invention includes a step S40 of controlling one differential pressure sensor 100 to sense a difference between the pressures in the first through-hole 110 arranged between the inlet hole 32 for drawing air from the storage compartments 6 and 8 and the evaporator 20 and the second through-hole 120 arranged between the outlet hole 38 for discharging air into the storage compartments 6 and 8 and the evaporator 20; and a step of defrosting the evaporator by driving the heater 50 when the pressure difference is larger than a preset pressure.

Meanwhile, the pressure difference used in the present invention may mean a pressure difference value that is measured one time or an average of the pressure differences that is measured several times. The pressure measured by the differential pressure sensor 100 is likely to be calculated as an abnormal value by various external factors temporarily. In case of using the average of the pressure differences, the pressure difference measured by the differential pressure sensor 100 may become more reliable. When the pressure difference measured by the differential pressure sensor 100 is larger than a preset pressure, it means that the pressure difference between the first through-hole 110 and the second through-hole 120 becomes larger. The larger pressure difference may mean that the amount of the ice formed on the evaporator 20 increases enough to makes it difficult for the evaporator 20 to perform heat-exchange. Accordingly, the cold air supply to the storage compartments 6 and 8 from the evaporator 20 cannot be performed smoothly such that the defrosting may be needed. Moreover, before sensing the differential pressure, it may be determined whether the fan 40 is driving.

Only when the fan 40 has to drive, air flow may be generated between the first through-hole 110 and the second through-hole 120 and the differential pressure sensor 100 can then measure the difference between the pressures at the first and second through-holes 110 and 120 smoothly.

Accordingly, unless the fan 40 is driving, the differential pressure sensor 100 may not measure the pressure difference.

The door switch 70 may determine whether a preset time period elapses after the door 4 closes the storage compartments 6 and 8. Unless the preset time period elapses, the differential pressure sensor 100 may not measure the pressure difference S30. It is also possible for the door switch 70 to determine the door 4 is closed before the timer 80 measures the elapsed time and the elapsed time may be measured after that. At this time, the elapsed time may mean approximately 1 minute or be changed variously.

Unless the door 4 closes the storage compartments 6 and 8, the air flow in the case 35 may be different the air flow in a state where the case 35 is closed.

Moreover, unless a preset time passes after the door 4 is closed, an unexpected air flow is likely to be generated in the inlet hole 32 or the outlet hole 38 by the closing of the door 4.

If the differential pressure sensor 100 measures the pressure difference in this instance, it is difficult to say that the measured pressure difference reflects the pressure in the case 35. If a point of time for the defrosting for the evaporator is determined by using such wrong information, the heater 50 might be driven unnecessarily often or the evaporator 20 may not be defrosted by driving the heater 50 at a necessary point of time. Hence, the differential pressure sensor 100 may measure the pressure difference between the first through hole 110 and the second through-hole 120 S40. At this time, the information about the measured pressure difference may be transmitted to the control unit 96.

The control unit 96 compares the measured pressure difference, in other words, the differential pressure with a preset pressure (P1) S50. When the differential pressure is larger than the preset pressure (P1), it may be determined that much ice is formed on the evaporator 20 enough to require the defrosting process. If much ice is formed on the evaporator 20, sufficient heat-exchange is difficult in the evaporator 20 and sufficient cold air is difficult to be supplied to the storage compartments 6 and 8. The preset pressure (P1) may be set as approximately 20 Pa and it may be variable, considering the capacity and size of the refrigerator.

The control unit 96 performs the defrosting while supplying heat to the evaporator 20 by driving the heater 50 S60. As the evaporator 20 is arranged in the same space partitioned in the case 35 together with the heater 50, the heater 50 is driven and the temperature inside the case 35 rises only to raise the temperature inside the evaporator 20.

Then, some of the ice formed on the evaporator 20 is melt and changed into water and the other of the ice falls from the evaporator 20. Accordingly, the heat-exchange area where the evaporator 20 is able to directly heat-contact with air increases to enhance heat-exchange efficiency of the evaporator 20.

While the defrosting is performed, in other words, the heater 50 is driving, the evaporator temperature sensor 92 measures the temperature of the evaporator 20. When the temperature of the evaporator 20 is higher than a preset temperature (T1), it is determined that the evaporator 20 is sufficiently defrosted S70.

In other words, the control unit 96 may stop the driving of the heater 50. The fact that the temperature of the evaporator 20 is higher than the preset temperature (T1) may mean that the current condition of the evaporator 20 is able to be changed into a condition where the evaporator 20 is able to supply cold air to the storage compartments 6 and 8, rather than the condition where all of the ice formed on the evaporator is removed.

Unless the temperature of the evaporator 20 rises to the preset temperature (T1), it is determined that the evaporator 20 is not defrosted sufficiently and that the heater 50 is continuously driving to supply heat.

In one embodiment, a point of time for defrosting the evaporator 20 is determined based on the differential pressure measured by the differential pressure sensor 100. To enhance the reliability of the differential pressure measured by the differential pressure sensor 100, another condition may be added to form a stable state of air flow in the case 35.

If the defrosting for the evaporator 20 is performed unnecessarily often, the heater 50 is driven quite often and the electric power consumed by the heater 50 is then increased, only to lower the entire energy efficiency of the refrigerator.

Moreover, when the heat supplied by the heater 50 is drawn into the storage compartments 6 and 8 via the inlet or outlet hole, the foods stored in the storage compartments might go bad. Also, to chill the air heated by the heat supplied from the heater 50, the evaporator 20 has to supply more cold air.

Accordingly, the embodiment may save the electric power unnecessarily consumed by determining the point of time for the defrosting reliably and provide the refrigerator having the enhanced energy efficiency and the controlling method for the same.

FIG. 6 is a flow chart illustrating a control method of sensing ice-formation on an evaporator according to one modified embodiment.

Different from the embodiment shown in FIG. 5, one embodiment of FIG. 6 shows a step S10 of determining whether a sensing period using the differential pressure sensor 100 is satisfied before the step a step S20 of determining whether the fan is driving.

The sensing period means a time period in which the differential pressure is measured by using the differential pressure sensor 100. For example, the sensing period may be set as 20 seconds or set as variable time periods according to various conditions.

In the modified embodiment, when the pressure difference is measured by using the differential pressure sensor 100, the differential pressure sensor 100 senses the pressure difference in the sensing period, in other words, at preset time intervals. Accordingly, the electric power consumed by the differential pressure sensor 100 may be reduced.

If the differential pressure sensor 100 continuously measures pressure differences without the sensing period, it takes more electric power in transmitting the information measured by the differential pressure sensor 100 to the control unit 96 rather than the electric power consumed by the differential pressure sensor 100.

Accordingly, in the modified embodiment, the differential pressure sensor 100 may measure the pressure differences in the sensing periods to improve the energy efficiency of the refrigerator.

The other steps of FIG. 6 are equal to the steps described in FIG. 5 and repeated description is omitted accordingly.

FIG. 7 is a diagram illustrating a point of time for performing a defrosting process according to another embodiment.

Different from the above-described embodiment, this embodiment illustrates that the evaporator independently includes two evaporators configured of one refrigerator evaporator and the other freezer evaporator.

The point of time when the defrosting for the freezer evaporator is performed may be the same with the point of time when the defrosting for the refrigerator evaporator. On other hand, the points may be irrelevant. In other words, when the defrosting is performed for the freezer evaporator, the defrosting is performed for the refrigerator evaporator at the same time. one other hands, once a defrosting condition for the refrigerator evaporator is satisfied, the defrosting may be performed for the refrigerator evaporator without regard to the start point of the defrosting for the freezer evaporator. The condition in which the defrosting for the freezer evaporator starts may be the point of time when a specific time, for example, the actuation time of the freezer compartment is reduced from 43 hours to 7 hours. The maximum 43 hours is the reference time period. In a state where the freezer door is open for 1 second, 7 minutes is reduced. When the actuation time reaches 7 hours, the defrosting for the freezer evaporator may be performed.

The defrosting for the refrigerator evaporator may be performed together with the defrosting for the freezer evaporator, when the condition for starting the defrosting for the refrigerator evaporator is satisfied. In this instance, without consideration of the condition for starting the defrosting for the refrigerator evaporator, the defrosting for the refrigerator evaporator may be performed to belong to the defrosting for the freezer evaporator. In this instance, when the heater is driven to defrost the freezer evaporator, the defrosting for the refrigerator evaporator may be performed together.

On the other hand, the condition for starting the defrosting for the freezer evaporator may be a specific time period, for example, a point of time when the actuation time period of the refrigerator compartment is reduced from 20 hours to 7 hours. The maximum of 20 hours is set as the reference time period. 7 minutes are reduced in a state where the refrigerator door is open for 1 second. When the actuation time reaches 7 hours, the defrosting for the refrigerator evaporator may be performed.

Under such conditions, the defrosting for the refrigerator evaporator may be independently performed without regard to the defrosting for the freezer evaporator. In other words, when the condition for defrosting the freezer evaporator is satisfied, the defrosting for the freezer evaporator is performed. When the condition for defrosting the freezer evaporator is satisfied, the defrosting for the refrigerator evaporator may be performed.

Specifically, the defrosting for the freezer evaporator and the defrosting for refrigerator evaporator are independently only to perform the defrosting for the evaporators. In this instance, unless the condition for defrosting the freezer evaporator is satisfied even though the heater is driven to defrost the freezer evaporator, the defrosting for the refrigerator evaporator may not be performed.

More specifically, in this embodiment, the condition for starting the defrosting for the freezer evaporator and the condition for starting the defrosting for the refrigerator evaporator may be configured independently. On the other hand, the point of time when the defrosting for the freezer evaporator is performed may set equal to the point of time when the defrosting for the refrigerator evaporator is performed. Moreover, the point of time when the defrosting for the refrigerator evaporator is performed may be set equal to the point of time when the defrosting for the freezer evaporator is performed.

In FIG. 7, the evaporator is divided into the freezer evaporator and the refrigerator evaporator. However, when one evaporator is installed in the refrigerator, one of the conditions set to defrost the freezer evaporator and the refrigerator evaporator is selected. Once the selected condition is satisfied, the defrosting for the evaporator may start.

FIG. 8 is a flow chart illustrating a control method of sensing a degree of ice-formation on an evaporator after a defrosting process starts according to the embodiment.

In the embodiment of FIG. 8, a degree of the ice-formation on the evaporator is sensed. When a little ice is formed, the defrosting logic is optimized and the power consumption may be improved.

Referring to FIG. 8, it is determined whether a defrosting start condition for the evaporator 20 is satisfied S110. The defrosting start condition shown in FIG. 7 may be set in consideration of the driving time of the compressor 60 to chill the storage compartments and the open time of the door 4.

Of course, the defrosting start condition may be set in other methods and the defrosting start condition may be determined by using the differential pressure sensor 100.

Once the defrosting start condition is satisfied, the differential pressure sensor 100 senses the pressure difference. When the measured pressure difference is transmitted to the control unit 96, it is determined whether the measured pressure difference is a specific pressure value or more S120.

At this time, the specific pressure may be variable by the user or worker diversely.

When the measured pressure difference is a specific pressure or more, a first defrosting is performed S130.

In the first defrosting, the heater 50 may be driven to melt the ice formed on the evaporator 20.

At this time, the control unit 96 may heat the evaporator to have a preset temperature by using the heater 50. At this time, the first preset temperature may be approximately 5° C. In other words, the control unit 96 may drive the heater 50 until the temperature of the evaporator 20 rises to the first preset temperature, when the pressure difference measured by the differential pressure sensor 100 is the specific pressure or more. In this instance, the heater 50 may be continuously driven until the step S130 finishes, in other words, until the temperature measured by the evaporator temperature sensor 92 rises to the first preset temperature. The control unit 95 may keep an ON-state of the heater 50 without switching off the heater 50 until the temperature measured by the evaporator temperature sensor 92 rises to the first preset temperature and the ice formed on the evaporator 20 may be eliminated.

On the other hand, when the measured pressure difference is smaller than the specific pressure, a second defrosting is performed S150.

In the second defrosting, the heater 50 may be driven to melt the ice formed on the evaporator 20.

At this time, the control unit 96 may heat the evaporator 20 by using the heater 50 until the temperature of the evaporator 20 rises a second preset temperature. At this time, the second preset temperature may be approximately 1° C.

The first preset temperature may be higher than the second preset temperature. In other words, the second defrosting may end once the temperature of the evaporator 20 reaches a relatively lower temperature, compared with the first defrosting.

Compared with the first defrosting, it is determined in the second defrosting that a small amount of ice is formed on the evaporator 20. To eliminate the ice formed on the evaporator 20, the evaporator 20 is heated in the second defrosting until the lower temperature.

Specifically, in this embodiment, the amount of the ice formed on the evaporator 20 is expected by the differential pressure sensor 100. When a relatively large amount of ice is formed, the evaporator 20 is heated to a relatively high temperature. When a relatively small amount of ice is formed, the evaporator 20 may be heated to a relatively low temperature.

When the small amount of the ice is formed on the evaporator 20, the heat-exchange efficiency of the evaporator 20 may become normal by controlling the heater 50 to supply relatively less heat. As there is the small amount of the ice the evaporator 20 has to melt, the heater 50 supplies a small amount of heat to perform the defrosting for the evaporator 20.

Accordingly, this embodiment may improve energy efficiency when performing the defrosting for the evaporator 20.

Meanwhile, the heater 50 may be continuously driven without being switching into on and off, until the temperature of the evaporator 20 reaches a specific temperature, for example, −5° C.

On the other hand, if the temperature of the evaporator 20 reaches over the specific temperature, the heater 50 is intermittently driven while being switched into on and off. During the actuation of the second defrosting, the temperature of the evaporator 20 is raised fast by the heater 50. However, when the temperature of the evaporator 20 is raised over the specific temperature, the heater 50 raises the temperature of the evaporator 20 relatively slow. When the defrosting is performed primarily, the temperature of the evaporator 20 may be raised fast. On the other hand, when the temperature of the evaporator is raised to the preset temperature or more, a preset time may be provided to cause the circulation due to convection of air between the evaporator 20 and the heater 50. Accordingly, even unless the temperature of the evaporator 20 is raised too high, the evaporator 20 may be exposed to the specific temperature or more and the ice formed on the evaporator may be eliminated by even less energy.

In other words, during the second defrosting, the heater 50 is repeatedly switched on and off to save the energy consumed by the heater 50.

In the first defrosting, the evaporator 20 is heated to a high temperature. On the other hand, in the second defrosting, the evaporator 20 is heated to a relatively low temperature. The two defrosting processes may be differently selected according to the amount of the ice formed on the evaporator 20.

After the first defrosting is completed, a first normal operation is performed S140.

The first normal operation step means a process of chilling the storage compartments. Especially, the first normal operation step may mean that the storage compartments are primarily chilled to a preset temperature after the first defrosting is completed. At this time, the preset temperature may mean the temperature set by the user or the temperature which is somewhat different from the temperature of the storage compartment.

In the first normal operation step, the compressor 60 may be driven to generate a high cooling power.

As temperature of the evaporator 20 is raised to the relatively high temperature in the first defrosting, a higher cooling power is required to lower the temperature of the evaporator 20. In addition, as the temperature inside the case 35 is raised, the temperature inside the storage compartments is likely to rise. Accordingly, the compressor 60 may be driven at a relatively high driving rpm to generate a stronger cooling power and cool the evaporator 20 rapidly.

After the second defrosting, a second normal operation is performed S160.

The second normal operation step means a process of chilling the storage compartments. Especially, the second normal operation step may mean that the storage compartments are primarily cooled to a preset temperature after the second defrosting. At this time, the preset temperature may mean the temperature of the storage compartments set by the user or the temperature which is a little different from the storage compartment temperature.

In the second normal operation, the compressor 60 may be driven to generate a lower cooling power.

Compared with the first defrosting, the heater 50 supplies less heat in the second defrosting to finish the defrosting. Also, as the temperature of the evaporator 20 is relatively low in the second defrosting, the temperature of the storage compartments is not likely to rise in comparison with the first defrosting.

Accordingly, in the second normal operation step, the compressor 60 generates a relatively low cooling power and the energy efficiency may be enhanced. In other words, the control unit 96 drives the compressor 60 at a relatively low driving rpm and cools the evaporator 20 slowly.

Specifically, in this embodiment, the degree of ice-formation on the evaporator 20 is sensed when the condition determined once the defrosting starts.

When it is determined that the amount of the ice is large based on the sensed information, much energy is supplied to defrost the evaporator 20. When it is determined that the amount of the ice is small, less energy is supplied to defrost the evaporator 20.

The degree of the defrosting is adjusted according to the amount of the ice formed on the evaporator. Accordingly, the reliability on the defrosting for the evaporator 20 may be enhanced and unnecessary energy consumption may be prevented.

Moreover, in this embodiment, the size of the cooling power may be set different according to the strength of the defrosting when the storage compartments are primarily chilled later. In a state where the temperature of the evaporator 20 is high, the compressor 60 is driven fast and a high cooling power is supplied to cool the evaporator 20 fast. On the other hand, in a state where the temperature of the evaporator 20 is low, the compressor 60 is driven slowly and a low cooling power is supplied to cool the evaporator 20 slowly.

FIG. 9 is a flow chart to determine whether additional defrosting is needed after the first defrosting according to the embodiment.

In this embodiment, only when it is determined that additional defrosting is required after the one defrosting, additional defrosting is performed and the energy used in the defrosting may be saved.

When the additional defrosting is performed in a state where the ice is sufficiently eliminated from the evaporator 20 even after the little defrosting, the energy consumed by the heater 50 has to become large. To lower the temperature raised by the heater 50, the compressor 60 has to be driven and the energy consumed by the compressor 60 becomes also increased.

To solve the above-noted problem, this embodiment shows that the defrosting is divided into a first defrosting step and a second defrosting step. Accordingly, it may be determined based on the residual ice whether to perform the second defrosting step. Referring to FIG. 9, in this embodiment, the heater 50 is driven S210 once a condition for starting the defrosting for the evaporator 20 is satisfied.

While the heater 50 is driven, the defrosting for the evaporator 20 is performed.

The evaporator temperature sensor 92 measures the temperature of the evaporator 20 and it is determined whether the measured temperature reaches a first temperature S220. Once the temperature of the evaporator 20 reaches the first temperature, it is determined that the defrosting for the evaporator 20 is completed and the heater 50 is switched off S230.

As the heater 50 is switched off, no more power is supplied to the heater 50.

Hence, the fan 40 is driven S240.

The differential pressure sensor 100 may measure the pressure difference while air flow is generated by the fan 40 S250.

It is determined whether the measured pressure difference is a preset pressure or less S260.

When the pressure difference measured by the differential pressure sensor 100 is the preset pressure or less, it is determined that sufficient defrosting is performed for the evaporator 20. In other words, it is expected that the heat-exchange efficiency of the evaporator 20 is a preset level or more and it is determined that the evaporator 20 is in a state of supplying sufficient cold air to the storage compartments.

Accordingly, it is determined that no additional defrosting for the evaporator 20 is required. After that, cold air may be supplied to the storage compartments by driving the compressor 60.

On the other hand, when the pressure difference measured by the differential pressure sensor 100 is larger than the preset pressure, it may be determined that insufficient defrosting is performed for the evaporator 20. In other words, it is expected that the heat-exchange efficiency of the evaporator 20 is a preset level or more and it may be determined that sufficient cold air cannot be supplied to the storage compartments. Accordingly, the control unit 96 switches the heater 50 on again to supply heat to the evaporator 20 S270.

After switching on the heater 50, the control unit 96 may supply heat to the evaporator 20 until the temperature of the evaporator 20 reaches a second temperature.

Once the temperature of the evaporator 20 reaches the second temperature, it is determined that the additional defrosting is completed and the defrosting ends S280.

After the defrosting ends in S260 or S280, an operation step of driving the compressor 60 to cool the storage compartments is performed.

When the pressure difference measured in S250 is a preset pressure or less, the second defrosting step S270 and S280 may not be performed but the operation step is performed.

On the other hand, when the pressure difference measured in S250 is a preset pressure or more, the operation step is performed after the second defrosting step S270 and S280 is performed.

In the operation step, the fan 40 is driven to supply the air heat-exchanged in the evaporator 20 to the storage compartments. In other words, the refrigerant compressed by the compressor 60 is re-supplied to the evaporator 20 and the air is cooled while exchanging heat with the evaporator 20. At this time, the cooled air is guided towards the storage compartments by the fan 40.

Meanwhile, the second temperature of the second defrosting step performed in S270 may be equal to the first temperature of the first defrosting step performed in S210.

After the fan 40 is driven, the temperature of the evaporator 20 is lowered while exchanging heat with the air drawn from the storage compartments. The heater 50 may be controlled to heat the evaporator 20 until the temperature of the evaporator 20 reaches the second temperature that is equal to the first temperature.

Even if the first temperature is equal to the second temperature, the temperature of the evaporator 20 is lowered by the fan 40 and the evaporator 20 is exposed to the temperature at which the ice can be eliminated from the evaporator for a relatively long time. Accordingly, the ice formed on the evaporator 20 may be eliminated even in the second defrosting step as well as the first defrosting step.

Different from that, the second temperature of the second defrosting step performed in S270 may be higher than the first temperature of the first defrosting step performed in S210.

In the second defrosting step, the heater 50 supplies more heat to the evaporator 20 to provide an environment where the residual ice is eliminated from the evaporator 20.

As the temperature of the evaporator 20 rises even to the second temperature that is relatively high in the second defrosting step, the ice not eliminated in the first defrosting step may be eliminated. Accordingly, the reliability on the evaporator 20 may be enhanced.

As the temperature of the evaporator 20 rises even to a higher temperature in the second defrosting step, the evaporator 20 may be exposed to the higher temperature than in the first defrosting step. Moreover, the evaporator is provided with the time for melting the ice during the first defrosting step and during the second defrosting step. Accordingly, the entire time for melting the ice may be increased.

Accordingly, the ice formed on the evaporator 20 may be secondarily eliminated in the second defrosting step and the reliability of the defrosting may be enhanced.

Meanwhile, S250 may be performed after the step of driving the fan 40 is performed for a specific time period. When the fan 40 is driving, air flow is unstable in the case 35 and a high noise value could be measured by the differential pressure sensor 100. Accordingly, it is preferred that the amount of the residual ice in the evaporator 20 is sensed by using the pressure difference value measured by the differential pressure sensor 100 after the fan 40 is driven for a specific time period, for example, approximately 5 seconds.

Meanwhile, S240 may be performed in a preset time period after S230 is performed. Before S230 is performed, the electric power is supplied to the heater 50 and the heater 50 is in a state where heat is emitted. Meanwhile, heat is remaining in the heater even after being off and such heat is likely to raise the temperature inside the case 35 for a preset time period.

Accordingly, when the fan 40 is driven as soon as the heater 50 is switched off, hot air might be supplied to the storage compartments by the air flow generated by the fan 40. If the temperature of the storage compartments rises, the stored foods might go bad.

In this embodiment, the driving of the fan 40 starts in a preset time period, for example, in a pause period of approximately 1 minute after the first defrosting is completed, in other words, the heater 50 is switched off. Accordingly, the air heated by the heater 50 may be prevented from being supplied to the storage compartments, without melting the ice formed on the evaporator 20.

Moreover, in the first defrosting step and the second defrosting step, it is preferred that the fan 40 is not driven. The hot air heated by the heater 50 should not be supplied to the storage compartments by the fan 40.

Specifically, as the heater 50 generates heat in the on-state, it is preferred that the fan 40 is not driven.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds, are therefore intended to be embraced by the appended claims.

What is claimed is:

1. A control method for a refrigerator comprising:

determining whether a defrosting start condition for an evaporator is satisfied;

a first defrosting step of performing defrosting for the evaporator, the first defrosting step which ends when a temperature of the evaporator reaches a first temperature;

a pressure difference sensing step of measuring a difference between a pressure in a first through-hole arranged between an inlet hole for drawing air from a storage compartment and the evaporator and a pressure in a second through-hole arranged between an outlet hole for discharging air towards the storage compartment and the evaporator by using a single differential pressure sensor; and a second defrosting step of performing additional defrosting for the evaporator when the measured pressure difference is larger than a preset pressure, wherein the defrosting start condition is set in consideration of a driving time of a compressor and an open time of a door.

2. The control method of claim 1, further comprising:

an operation step of driving a compressor to cool the storage compartment when the measured pressure difference is the preset pressure or less.

3. The control method of claim 2, wherein the operation step is performed after the second defrosting step is completed, when the measured pressure difference is the preset pressure.

4. The control method of claim 2, wherein the operation step further comprises driving a fan to supply air heat-exchanged with the evaporator to the storage compartment.

5. The control method of claim 1, further comprising driving a heater to heat the evaporator in the first defrosting step and the second defrosting step.

6. The control method of claim 1, wherein the first temperature is lower than a second temperature reached by the evaporator in the second defrosting step.

7. The control method of claim 1, wherein the first temperature is equal to a second temperature reached by the evaporator in the second defrosting step.

8. The control method of claim 1, further comprising:

a step of driving a fan to supply air heat-exchanged in the evaporator to the storage compartment, the fan driving step arranged between the first defrosting step and the pressure difference sensing step.

9. The control method of claim 8, wherein the pressure difference sensing step is performed after the fan driving step is performed for a specific time period.

10. The control method of claim 8, wherein the fan driving step is performed in a preset time period after the first defrosting step is completed.

11. The control method of claim 1, wherein in the first defrosting step and the second defrosting step, a fan to supply air heat-exchanged in the evaporator to the storage compartment is not driven.

12. A refrigerator comprising:

a cabinet in which a storage compartment is provided;

a door to open and close the storage compartment;

a case in which an evaporator is provided, the case comprising an inlet hole formed to draw air from the storage compartment and an outlet hole formed to discharge air into the storage compartment;

a fan provided to generate flow of air that is drawn via the inlet hole and discharged via the outlet hole;

a single differential pressure sensor provided in the case; and a controller configured to determine whether to perform defrosting for the evaporator according to a pressure difference sensed by the differential pressure sensor, wherein the controller is configured to determine a defrosting start condition for the evaporator and the defrosting start condition is set in consideration of a driving time of a compressor and an open time of a door.

13. The refrigerator of claim 12, further comprising:

a heater provided to heat the evaporator.

14. The refrigerator of claim 13, wherein the controller is configured to: operate the heater to perform a defrosting of the evaporator and end the operation of the heater when a temperature of the evaporator reaches a first temperature; determine the pressure difference sensed by the differential pressure sensor; and operate the heater to perform an additional defrosting of the evaporator when the determined pressure difference is larger than a preset pressure.

15. The refrigerator of claim 14, further comprising a compressor, wherein the controller is configured to drive the compressor to cool the storage compartment when the measured pressure difference is the preset pressure or less.

16. The refrigerator of claim 15, wherein the controller is configured to drive the fan to supply air heat-exchanged with the evaporator to the storage compartment when the storage compartment is cooled.

17. The refrigerator of claim 12, wherein the controller is configured to measure the pressure difference after a defrosting of the evaporator by the heater is performed.

18. The refrigerator of claim 12, wherein the differential pressure sensor comprises, a first through-hole arranged between the evaporator and the inlet hole;

a second through-hole arranged between the evaporator and the outlet hole; and a body provided to connect with the first through-hole and the second through-hole, and an electronic circuit configured to sense a difference between a pressure of air penetrating the first through-hole and a pressure of air penetrating the second through-hole.

19. The refrigerator of claim 18, wherein the body includes:

a first pipe having the first through-hole formed therein and a second pipe having the second through-hole formed therein; and a connection member provided to connect the first pipe and the second pipe, wherein the electronic circuit is provided in the connection member.

20. The refrigerator of claim 19, wherein the first pipe and the second pipe are arranged to have the evaporator there between.

* * * * *